US011841148B2

(12) United States Patent
Martinez Galvan

(10) Patent No.: US 11,841,148 B2
(45) Date of Patent: Dec. 12, 2023

(54) WINDOW-TYPE AIR CONDITIONER

(71) Applicant: Electrolux Appliances Aktiebolag, Stockholm (SE)

(72) Inventor: Israel Martinez Galvan, Stockholm (SE)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 16/771,111

(22) PCT Filed: Dec. 13, 2017

(86) PCT No.: PCT/EP2017/082611
§ 371 (c)(1),
(2) Date: Jun. 9, 2020

(87) PCT Pub. No.: WO2019/114944
PCT Pub. Date: Jun. 20, 2019

(65) Prior Publication Data

US 2021/0190330 A1 Jun. 24, 2021

(51) Int. Cl.

| | |
|---|---|
| ***F24F 1/027*** | (2019.01) |
| ***F24F 1/0326*** | (2019.01) |
| ***F24F 1/031*** | (2019.01) |
| ***F24F 1/029*** | (2019.01) |

(52) U.S. Cl.
CPC ..... *F24F 1/027* (2013.01); *F24F 1/029* (2019.02); *F24F 1/031* (2019.02); *F24F 1/0326* (2019.02)

(58) Field of Classification Search
CPC . F25B 25/005; F25B 2313/003; F24F 1/0007; F24F 1/00077; F24F 1/029; F24F 1/031; F24F 1/0326; F24F 1/027
See application file for complete search history.

(56) References Cited

U.S. PATENT DOCUMENTS

| | | | |
|---|---|---|---|
| 399,491 | A | 3/1889 | Bukawietis |
| 1,954,017 | A | 4/1934 | Manning |
| 2,234,753 | A | 3/1941 | Frazer |
| 2,268,451 | A | 12/1941 | Hull |

(Continued)

FOREIGN PATENT DOCUMENTS

| | | | |
|---|---|---|---|
| CN | 2190590 | Y | 3/1995 |
| CN | 2413205 | Y | 1/2001 |

(Continued)

OTHER PUBLICATIONS

JP-2000002474-A Translation (Year: 2000).*

(Continued)

*Primary Examiner* — Schyler S Sanks
(74) *Attorney, Agent, or Firm* — RatnerPrestia

(57) ABSTRACT

A split air conditioner having an indoor unit and an outdoor unit. A piping system interconnects the indoor unit with the outdoor unit. The indoor unit has an indoor heat exchanger for cooling or heating air in the indoor unit. The outdoor unit has a compressor, a first outdoor heat exchanger, and a second outdoor heat exchanger. The compressor is configured to drive a refrigerant via the first outdoor heat exchanger and the second outdoor heat exchanger in a refrigerant circuit. The piping system is configured to circulate an energy transport media from the first outdoor heat exchanger via the piping system to the indoor heat exchanger.

14 Claims, 2 Drawing Sheets

(56) References Cited

U.S. PATENT DOCUMENTS 2,320,436 A 6/1943 Hull
2,436,713 A 2/1948 Cody
2,568,968 A 9/1951 Perrin
2,608,148 A 8/1952 Shapiro
2,708,833 A 5/1955 Nigro
2,814,244 A 11/1957 Hord
2,818,793 A 1/1958 Hord
2,925,026 A 2/1960 Schuster et al.
2,935,284 A 5/1960 Reeves
3,030,873 A 4/1962 Metcalfe
3,134,319 A 5/1964 Marsteller
3,476,033 A 11/1969 Appel
3,481,264 A 12/1969 Ulich
3,491,549 A 1/1970 Oglesby
3,552,470 A 1/1971 Metcalfe
3,554,476 A 1/1971 Gaylor, Jr.
3,698,208 A 10/1972 Navara
3,698,308 A 10/1972 Navaro
3,911,803 A 10/1975 Kong et al.
4,086,886 A 5/1978 Edmaier et al.
4,152,844 A 5/1979 Materniak et al.
4,203,302 A 5/1980 Lapeyre
4,334,461 A 6/1982 Ferguson et al.
5,027,614 A 7/1991 Mori et al.
5,167,131 A 12/1992 Karkhanis
5,290,343 A 3/1994 Morita et al.
5,365,992 A 11/1994 Swain et al.
5,582,025 A 12/1996 Dubin et al.
5,823,289 A 10/1998 Csomos
5,979,172 A 11/1999 Teller
5,979,533 A 11/1999 Dupuie
6,173,930 B1 1/2001 Arbucci
6,257,013 B1 7/2001 Murray et al.
6,416,570 B2 7/2002 Goto et al.
6,568,201 B1 5/2003 Cur et al.
6,767,278 B1 7/2004 Peterson
7,121,105 B1 10/2006 Rais
7,296,424 B2 11/2007 Thompson
7,332,019 B2 2/2008 Bias et al.
7,350,759 B1 4/2008 Gray
7,601,204 B2 10/2009 Woodruff et al.
7,854,141 B1 10/2010 Breen
7,896,957 B2 3/2011 Zhao et al.
7,975,441 B2 7/2011 McCarriston
8,091,844 B1 1/2012 Bragg
8,104,240 B2 1/2012 McCarriston
8,578,728 B2 11/2013 Cho et al.
8,584,998 B1 11/2013 Peterson
9,163,854 B2 10/2015 Arbuccci
9,179,794 B2 11/2015 Darby
9,303,895 B1 4/2016 Grant
9,447,916 B2 9/2016 Darby et al.
D782,289 S 3/2017 Darby et al.
9,605,870 B2 3/2017 Darby et al.
9,909,712 B1 3/2018 Darby
9,938,044 B2 4/2018 Gamboa
9,982,909 B1 5/2018 Perez et al.
10,077,918 B2 9/2018 Darby et al.
10,104,964 B2 10/2018 Darby
10,203,130 B2 2/2019 Gardikis et al.
10,203,180 B2 2/2019 Miller et al.
10,295,221 B2 5/2019 Zhang
10,359,212 B2 7/2019 Darby
10,401,043 B2 9/2019 Li
10,408,494 B2 9/2019 Darby
10,520,206 B2 12/2019 Xu et al.
10,712,058 B2 7/2020 Itakura et al.
10,775,054 B2 9/2020 Bradford et al.
10,900,689 B2 1/2021 Weiner
2001/0032545 A1 10/2001 Goto et al.
2003/0097854 A1 5/2003 Cur et al.
2003/0110789 A1* 6/2003 Cur ..... F24F 1/027 62/262
2005/0028545 A1 2/2005 Herbert
2006/0021359 A1 2/2006 Hur et al.
2006/0223434 A1 10/2006 Barker
2007/0023592 A1 2/2007 Makaso
2007/0068185 A1 3/2007 Thompson
2007/0137237 A1 6/2007 Rais
2008/0053309 A1 3/2008 Woodruff et al.
2008/0104989 A1 5/2008 Movshovitz
2010/0077924 A1 4/2010 Zhao et al.
2010/0197214 A1 8/2010 Geremia, Sr. et al.
2010/0229585 A1* 9/2010 Bradford ..... F24F 1/34 62/291
2010/0326103 A1 12/2010 Stamm et al.
2012/0137499 A1 6/2012 Agniotri
2012/0274188 A1 11/2012 Shiborino
2013/0104581 A1* 5/2013 Consoli ..... F28D 5/00 62/171
2013/0153744 A1 6/2013 Jin et al.
2013/0327509 A1 12/2013 Michitsuji
2014/0020421 A1 1/2014 Gallo
2014/0076506 A1 3/2014 Olivas
2014/0090334 A1 4/2014 Darby et al.
2014/0311063 A1 10/2014 McIntyre
2015/0034784 A1 2/2015 Darby
2015/0097096 A1 4/2015 Arbucci
2015/0211802 A1 7/2015 Yokozeki et al.
2015/0354838 A1 12/2015 Cur et al.
2016/0033166 A1 2/2016 Herbert
2016/0058189 A1 3/2016 Darby
2016/0097547 A1 4/2016 Selg et al.
2016/0298872 A1 10/2016 Darby et al.
2016/0377306 A1* 12/2016 Drees ..... H02J 3/28 700/295
2017/0153041 A1 6/2017 Darby et al.
2017/0159948 A1 6/2017 Darby
2017/0191763 A1 7/2017 Xu et al.
2017/0254557 A1 9/2017 Chiu
2017/0284683 A1 10/2017 Gallo et al.
2017/0297768 A1 10/2017 Gamboa
2017/0328596 A1 11/2017 Darby
2018/0023842 A1 1/2018 Gardikis, Sr. et al.
2018/0180305 A1 6/2018 Zhang
2019/0056143 A1 2/2019 Zhang
2019/0063760 A1 2/2019 Li
2019/0212028 A1 7/2019 Zemborain et al.
2019/0212032 A1 7/2019 Galvan
2020/0124296 A1 4/2020 Baumann et al.
2020/0248911 A1 8/2020 Lei et al.
2020/0333021 A1 10/2020 Galvan
2020/0363075 A1 11/2020 Bradford et al.
2021/0010688 A1 1/2021 Biasotti et al.
2021/0078118 A1 3/2021 Li et al.
2021/0088251 A1 3/2021 Martinez Galvan et al.
2021/0180828 A1 6/2021 Xing et al.
2021/0356146 A1 11/2021 Zhang et al.
2021/0404749 A1 12/2021 Wexler et al.

FOREIGN PATENT DOCUMENTS

CN 1338593 A 3/2002
CN 1445491 A 10/2003
CN 1595005 A 3/2005
CN 1727764 A 2/2006
CN 201104001 Y 8/2008
CN 201249077 Y 6/2009
CN 101523120 A 9/2009
CN 201589348 U 9/2010
CN 103471223 A 12/2013
CN 203379993 U 1/2014
CN 203501389 U 3/2014
CN 203518172 U 4/2014
CN 104061632 A 9/2014
CN 203980467 U 12/2014
CN 204141751 U 2/2015
CN 204153874 U 2/2015
CN 204202053 U 3/2015
CN 204491248 U 7/2015
CN 105202831 A 12/2015
CN 205037425 U 2/2016
CN 205137735 U 4/2016
CN 106152315 A 11/2016

(56) References Cited

FOREIGN PATENT DOCUMENTS

| | | | | | |
|---|---|---|---|---|---|
| CN | 106949559 | A | | 7/2017 | |
| CN | 206369283 | U | | 8/2017 | |
| CN | 107980091 | A | | 5/2018 | |
| CN | 207963424 | U | | 10/2018 | |
| CN | 108800686 | A | | 11/2018 | |
| CN | 109073269 | A | | 12/2018 | |
| CN | 109631434 | A | | 4/2019 | |
| DE | 4230604 | A1 | | 3/1994 | |
| EP | 0756140 | A2 | | 1/1997 | |
| EP | 1248049 | A2 | | 10/2002 | |
| EP | 1956307 | A1 | | 8/2008 | |
| EP | 2063192 | A1 | | 5/2009 | |
| EP | 2602420 | A2 | | 6/2013 | |
| EP | 3276279 | A1 | | 1/2018 | |
| FR | 755472 | A | | 11/1933 | |
| GB | 212669 | | | 3/1924 | |
| GB | 1239997 | | | 7/1971 | |
| GB | 2126695 | A | * | 3/1984 | ..... F24F 1/0003 |
| GB | 2126695 | A | | 3/1984 | |
| JP | 54105838 | A | | 8/1979 | |
| JP | 07248128 | A | | 9/1995 | |
| JP | 08226745 | A | | 9/1996 | |
| JP | 08285413 | A | | 11/1996 | |
| JP | 2000002474 | A | * | 1/2000 | |
| JP | 2001239121 | A | | 9/2001 | |
| JP | 2002357338 | A | | 12/2002 | |
| JP | 2009144984 | A | | 7/2009 | |
| JP | 2012132640 | A | | 7/2012 | |
| JP | 2018123717 | A | | 8/2019 | |
| KR | 20050117664 | A | | 12/2005 | |
| KR | 20070077917 | A | | 7/2007 | |
| KR | 20160086637 | A | | 7/2016 | |
| KR | 20160111687 | A | | 9/2016 | |
| KR | 102187381 | B1 | | 12/2020 | |
| KR | 20210077328 | A | | 6/2021 | |
| WO | 8800676 | A1 | | 1/1988 | |
| WO | 0190657 | A1 | | 11/2001 | |
| WO | 2005054751 | A2 | | 6/2005 | |
| WO | 2005116530 | A1 | | 12/2005 | |
| WO | 2009052372 | A2 | | 4/2009 | |
| WO | 2011079371 | A1 | | 7/2011 | |
| WO | 2012056164 | A1 | | 5/2012 | |
| WO | 2014188526 | A1 | | 11/2014 | |
| WO | 2014206846 | A1 | | 12/2014 | |
| WO | 2015098157 | A1 | | 7/2015 | |
| WO | 2015115929 | A1 | | 8/2015 | |
| WO | 2017001914 | A1 | | 1/2017 | |
| WO | 2017045909 | A1 | | 3/2017 | |
| WO | 2017045934 | A1 | | 3/2017 | |
| WO | 2017075658 | A1 | | 5/2017 | |
| WO | 2017194092 | A1 | | 11/2017 | |
| WO | 2018090114 | A1 | | 5/2018 | |
| WO | 2020038239 | A1 | | 2/2020 | |

OTHER PUBLICATIONS

International Preliminary Report on Patentability for International Application No. PCT/EP2017/082615, dated Jun. 16, 2020, 7 pages.
International Preliminary Report on Patentability for International Application No. PCT/EP2017/082611, dated Jun. 16, 2020, 7 pages.
International Search Report and Written Opinion for International Application PCT/EP2017/082615, dated Aug. 9, 10 pages.
International Search Report and Written Opinion for International Application PCT/EP2017/082611, dated Aug. 9, 2018, 10 pages.
Chinese Office Action for Chinese Application No. 201780097456.6, dated Jan. 6, 2021, with translation, 19 pages.
Chinese Office Action with Search Report for Chinese Application No. 201780097448.1, dated Jan. 12, 2021, 8 pages.
Chinese Office Action with Search Report for Chinese Application No. 201780097449.6, dated Jan. 12, 2021, 8 pages.
"Evidence for Common Knowledge," 2014, 6 pages.
Chinese Office Action with Search Report for Chinese Application No. 201780097448.1, dated Jun. 29, 2021, with translation, 14 pages.
Non Final Office Action for U.S. Appl. No. 16/771,456, dated Nov. 10, 2021, 39 pages.
International Preliminary Report on Patentability for International Application No. PCT/EP2017/082610, dated Jun. 16, 2020, 5 pages.
International Search Report and Written Opinion for International Application PCT/EP2017/082610, dated Aug. 21, 2018, 7 pages.
Chinese Office Action for Chinese Application No. 201680028498.X, dated Sep. 4, 2019, with translation, 15 pages.
Chinese Office Action for Chinese Application No. 201680085261.5, dated Apr. 14, 2020, 11 pages.
Chinese Office Action for Chinese Application No. 201680085261.5, dated Dec. 11, 2020, with translation, 28 pages.
European Communication pursuant to Article 94(3) for European Application No. 16 721 184.6, dated Oct. 7, 2020, 7 pages.
International Search Report and Written Opinion for International Application No. PCT/IB2016/000949, dated Nov. 2, 2016, 9 pages.
International Search Report and Written Opinion for International Application No. PCT/EP2016/060396, dated Jan. 24, 2017, 9 pages.
International Search Report and Written Opinion for International Application No. PCT/EP2016/070382, dated Dec. 1, 2016, 14 pages.
International Search Report and Written Opinion for International Application No. PCT/EP2016/070702, dated Dec. 9, 2016, 9 pages.
Non Final Office Action for Application No. 16/771,107, dated Feb. 8, 2022, 11 pages.
Chinese Office Action for Chinese Application No. 2016800860880, dated Jan. 26, 2021, with translation, 18 pages.
International Search Report and Written Opinion for International Application No. PCT/EP2016/062022, dated Jan. 23, 2017—9 pages.
Chinese Office Action for Chinese Application No. 2016800860880, dated May 7, 2020, 8 pages.
Notice of Allowance for U.S. Appl. No. 16/771,107, dated Jul. 20, 2022, 9 pages.
Non Final Office Action for U.S. Appl. No. 17/558,962, dated Jun. 13, 2023, 16 pages.
Chinese Office Action for Chinese Application No. 201980102818.5, dated Sep. 1, 2023, 8 pages.

* cited by examiner

WINDOW-TYPE AIR CONDITIONER

This application is a U.S. National Phase application of PCT International Application No. PCT/EP2017/082611, filed Dec. 13, 2017, which is incorporated by reference herein.

TECHNICAL FIELD

The invention relates to an air conditioner. In particular the present invention relates to a split air-conditioner configured to be installed in a window.

BACKGROUND

Air conditioning is a collective expression for conditioning air into a desired state. It could be heating the air during cold periods, cooling the air during warmer periods or for cleaning the air if it contains unwanted particles. However, the expression air conditioning is most often used when emphasizing cooling. As a product, air conditioners can look and be used in various ways, but they all share the same basic technology. The air-conditioner comprises a compressor, a condenser, an evaporator, and typically also an expansion device.

There are different types of air-conditioners. One type of air-conditioner can be referred to as a split air-conditioner. In a split air conditioner, the condenser and the evaporator are located in two different separated units that are interconnected via pipes to circulate a refrigerant from one unit to the other.

Another type of air-conditioner can be referred to a Packaged Air Conditioner. A Packaged Air Conditioner (AC) can be said to be a type of self-contained system, in which all the cooling cycle components, such as the compressor, condenser, expansion device, evaporator and control system are enclosed in a single package. Among the packaged systems, the most commonly used for residential applications are the Window-type ACs, Packaged Terminal AC's (PTAC), and also Portable AC units.

The Packaged Air Conditioner has the advantages of easy installation, relatively small footprint, flexibility for heating/cooling individual rooms and low cost.

In contrast, Split Air Conditioners comprise at least two factory-made separated assemblies, designed to be used together. In a split system, the outdoor unit is separated by some distance from the indoor one(s) by means of semi rigid pipes which contain the refrigerant (at high pressure well above atmospheric pressure) that produces the cooling/heating effect in the system. Among other advantages, split systems can provide high efficiency ratios in a wide range of capacities and working conditions. Additionally, in split AC systems, the compressor, outdoor heat exchanger and outdoor fan can be located further away from the inside space, rather than merely on the other side of the same unit (as in PTACs or window air conditioners), achieving lower indoor noise levels.

Some disadvantages of the Split ACs are their higher price and their additional installation costs, since in most of the cases it is required qualified personnel to execute a proper installation. This issue can be especially critical because of the technical limitations for the users to manipulate specific working fluids like HFC-refrigerants, commonly used in Air Conditioning applications. EP 0468576 describes a type of air-conditioner with a portable AC where the excess heat and water can be removed using a water based hose system to an outside unit comprising a heat exchanger.

There is a constant desire to improve air conditioners. Hence, there exists a need for an improved air conditioner.

SUMMARY

It is an object of the present invention to provide an improved air-conditioner.

This object is obtained by an air conditioner as set out in the appended claims.

In accordance with the invention an easy to install air-conditioner is provided. The air-conditioner can be said to be a type of split air-conditioner comprising an outdoor unit that includes a complete refrigeration system. The cooling/heating of the outdoor unit is then circulated indirectly via an energy transport medium to the indoor unit. The air-conditioner is particularly suited for installation in a window opening.

In accordance with a first aspect of the invention an air conditioner configured to be installed in a window is provided. The air conditioner comprises an indoor unit and an outdoor unit. Further provided is a piping system that interconnects the indoor unit with the outdoor unit. The indoor unit comprises an indoor heat exchanger for cooling or heating air in the indoor unit. The outdoor unit comprises a compressor, a first outdoor heat exchanger, such as a liquid-to-refrigerant heat exchanger, and second outdoor heat exchanger, such as an air-to-refrigerant heat exchanger. The compressor is configured to drive a refrigerant via the first outdoor heat exchanger and the second outdoor heat exchanger in a refrigerant circuit. In addition, the piping system is configured to circulate an energy transport media from the first outdoor heat exchanger to the indoor heat exchanger. Hereby a compact, robust air conditioner suited for window installation is obtained. The energy transport media can be circulated at low pressure whereby connection of the indoor unit and outdoor unit can be made easy. Also, all noisy and bulky components can be located in the outdoor unit, which improves the indoor environment.

In accordance with one embodiment, the energy transport media is a water based solution such as water or water with some additive. Hereby an easy to handle energy transport media that is user-friendly can be used in the circulating system that cools (or heats) the indoor air.

In accordance with one embodiment, a main pump is provided in the indoor unit to circulate the energy transport media. Hereby an efficient circulation of the energy transport media is obtained and the pump is easy to access for maintenance.

In accordance with one embodiment, a liquid tank is connected to the piping system. Hereby, liquid can be filled to the piping system in an easy manner.

In accordance with one embodiment, the liquid tank is located at a top position of the piping system. The liquid tank can be provided with a one-way valve. Hereby, an efficient filling that can be obtained that keeps air out from the piping system when the system is in use.

In accordance with one embodiment, a box is located under the indoor heat exchanger for collecting condensate water. Hereby condensate water can be collected by a user.

In accordance with one embodiment, an arrangement for pumping condensate water from the indoor unit to the outdoor unit is provided. Hereby condensate water that for example can be collected by the box can be ejected to the outside and does not need to be taken care of by a user.

In accordance with one embodiment, the piping system comprises a connection device. The connection device can advantageously be located on the top part of the outdoor unit. Hereby an easy connection of the indoor unit and outdoor unit can be obtained. This can facilitate installation or de-installation when the indoor unit and out-door unit are separated.

In accordance with one embodiment, an arrangement for switching the air-conditioner between a cooling mode and a heating mode is provided. Hereby the air-conditioner can be made to cool air inside when the inside air is warm and to heat air inside when the inside air is cold.

In accordance with one embodiment, at least one heat exchanger in the outdoor unit is made of aluminum. Hereby a light construction of the outdoor unit can be obtained.

In accordance with a second aspect of the invention, an indoor unit of an air conditioner configured for window installation is provided. The indoor unit can comprise a liquid to air heat exchanger and a low-pressure circuit. In particular the low-pressure circuit can be configured to operate at around 1 bar. The low-pressure circuit passes through the liquid to air heat exchanger. The low-pressure circuit comprises at least one connector adapted to connect the indoor unit to an outdoor unit. Hereby, an easy to use indoor unit for a window installed air-conditioner is provided that takes little space and which does not produce any or very little noise.

In accordance with a third aspect of the invention, an outdoor unit of an air conditioner configured for window installation is provided. The outdoor unit comprises a packaged refrigeration system comprising a compressor, a liquid-to-refrigerant exchanger, and an air-to-refrigerant heat exchanger. The compressor is configured to drive a refrigerant via the air-to-refrigerant heat exchanger and the liquid-to-refrigerant heat exchanger in a refrigerant circuit. The liquid-to-refrigerant exchanger is configured to cool or heat an energy transport media circulated from an indoor unit. Hereby, an easy to use outdoor unit for a window installed air-conditioner is provided that comprises many of the noisy and bulky components of the air-conditioner. Also, all the components of the refrigeration circuit are located in the outside unit so there is no risk of hazardous refrigerant leakage inside.

In accordance with one embodiment the refrigerant circuit is factory sealed. Hereby, there is no need for a user to engage in handling the refrigerant.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. For example, the system as described herein is described as a cooling system, but the cooler can equally be a heater if the system is run in a heating mode. Some components can be omitted from different embodiments. Like numbers refer to like elements throughout the description.

As has been realized by the inventor, conventional air-conditioners of a split type are difficult and often expensive to install. Also, a system such as the one described in EP 0468576 requires the compressor, and all components of the refrigeration circuit, including the refrigerant, to be located in the space where cooling is to take place. This will add to space requirement of the indoor unit and also there will be a significant level of noise resulting from the operation of the compressor. Further, the refrigerant remains inside of the space to be conditioned, which is negative in case of leak of refrigerant. It would therefore be advantageous to provide a modified split air-conditioner that can be easily installed and that can provide an indirect-cooling air conditioner working with an external packaged refrigeration system.

Figure 1:
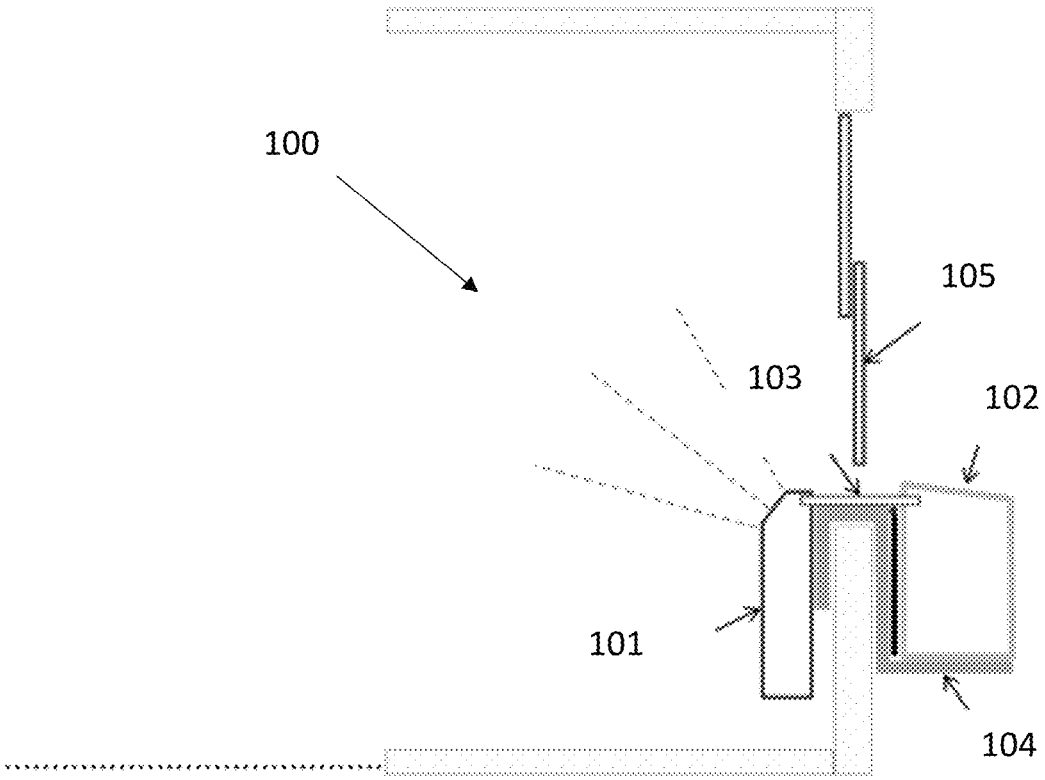
FIG. 1 shows a general view of an AC installation in a window opening.

FIG. 1 shows a schematic diagram of an embodiment of an air-conditioner 100. The air-conditioner 100 can be said to be of a split type with an indirect cooling system comprising an indoor unit 101 and a packaged outdoor cooling unit 102. The units 101, 102 are interconnected via an intermediate piping system 103. The piping system 103 and can advantageously use an energy transport media that is safe to use such as an aqueous solution. For example, water or water with some additive can be used as an energy transport media. Further, a mechanism 104 for installation of the air conditioner 100 is depicted. Also depicted is a window 105 where the air-conditioner 100 is installed. In this exemplary embodiment the window 105 is a standard hung type window. The air conditioner as described herein can also be installed in other type of windows such as a sliding window or some other openable window. Thus, the cooling system comprises a packaged refrigeration system mounted outside in an outdoor unit 102, an indoor unit 101 installed inside and a circuit that connects both units, which contains an energy transport media. The energy transport media can be at atmospheric pressure. The system can also be operated in another mode where the system is configured to heat the indoor unit. The indoor unit 101 will then be used as a heater.

Figure 2:
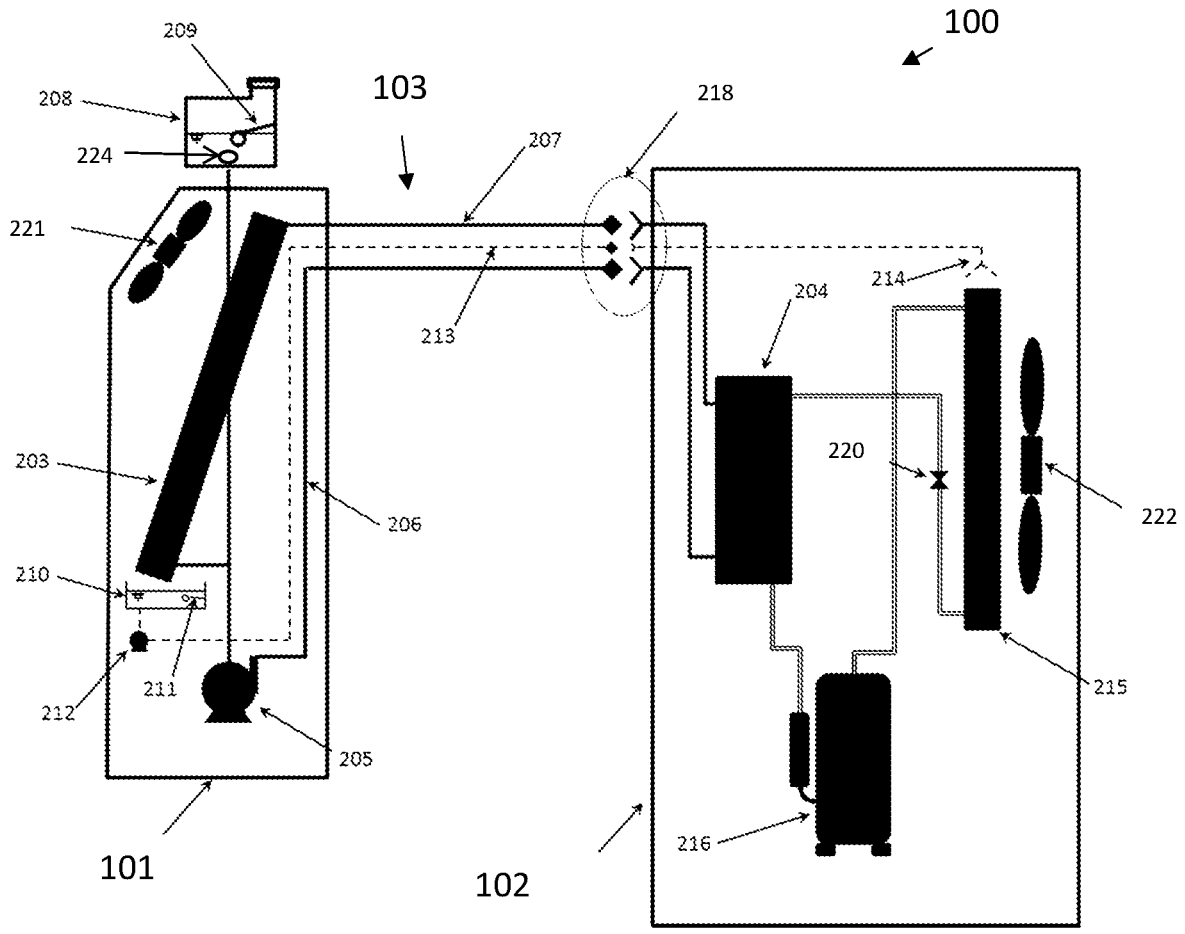
FIG. 2 illustrating a detailed exemplary embodiment of an Air-conditioner as shown in FIG. 1.

In FIG. 2, an exemplary implementation of the split type air-conditioner 100 of FIG. 1 is shown in more detail. FIG. 2 shows the indoor unit 101, and the outdoor unit 102. The indoor unit comprises an air-to-liquid heat exchanger 203. The air-to-liquid heat exchanger 203 cools (or heats) the air flowing in the indoor unit 101. Further, a liquid-to-refrigerant heat exchanger 204 is provided in the outdoor unit 102. The liquid-to-refrigerant heat exchanger 204 works as evaporator. Further a main pump 205 is provided to circulate a liquid solution used as an energy transport media from the indoor unit 101 to the outdoor unit 102 (and back again). The main pump can also be located in the outdoor unit 102. The liquid solution is circulated via the piping system 103. In this example the connection system 103 is formed by two connection pipes 206 and 207. Since, the piping system 103 can be made to work at relatively low pressure (around 1 bar), the pipes 206 and 207 can alternatively be hoses or similar devices that are easy to handle and can be provided with connectors that can withstand a low pressure. The outdoor unit 102 further comprises a refrigeration system, comprising a compressor 216 driving a refrigerant via that an air-cooled heat exchanger 215 via an expansion valve 220 and the heat exchanger 204 back to the compressor 216. The refrigeration system of the outdoor unit can be factory installed such that the user or installer does not have to work with the circuit circulating the refrigerant. The refrigerant circulated via the air-cooled heat exchanger 215 can then be filled in the factory. There will then be no need to handle a refrigerant during installation, because the refrigerant circuit of the outdoor unit 102 is factory sealed.

Further, a liquid tank 208 can be located on the top of the system. The liquid tank 208 can be connected to the circuit circulating the energy transport media. In accordance with one example the liquid tank can be connected to the suction port of the main pump 205. The tank 208 can include a level sensor 209 for controlling the amount of liquid solution circulated between the indoor unit 101 and the outdoor unit 102 needed for proper operation of the system 100. A box 210 can be provided under the indoor heat exchanger 203 for collecting any condensate that is generated on the indoor heat exchanger 203. A sensor 211 can be provided to detect the water level inside of the condensate box 210. The sensor 211 can generate a signal that can be used to control a condensate water pump 212. When activated the water pump 212 is adapted to pump water from the box 210 to outside of the indoor unit 101. In particular water can be pumped outside of the building where the indoor unit is mounted to be released on the outside. Hereby an arrangement that can pump condensate water from the indoor unit 101 to the outside is obtained.

In accordance with some embodiments the water is pumped to the outside unit 102. The pumped water can then for example be pumped through a drainage line 213 towards a spray device 214 located on the top of the outdoor air-cooled heat exchanger 215, which is connected to the compressor 216. FIG. 2 further depicts a fan 221 provided in the indoor unit 101 for circulating air in the indoor unit. Also, a fan 222 is provided in the outdoor unit for circulating air in the outdoor unit 102. The piping system 103 can further be provided with a connection device 218. The connection device 218 can for example be a quick connection to in a quick and safe manner interconnect the piping of the indoor unit 101 with the piping of the outdoor unit 102. The connection device 218 can advantageously be located on the top part of the outdoor unit for easy access. By connecting the indoor unit 101 with the outdoor unit 102, an energy transport media can be circulated between the indoor unit 101 and the outdoor unit 102. Also, condensate water can be transported from the indoor unit to the outdoor unit 102 via the piping system 103.

In use, the air conditioner 100 decreases the temperature of the energy transport media using the external packaged AC device of the outdoor unit 102. The cooling capacity of the outdoor-unit 102 is then transported in to the indoor unit 101 via the piping system 103. The cooling capacity is then delivered using the low-pressure air-to liquid heat exchanger 203 of the indoor unit 101. Heat is then returned from the inside unit 101 to the outside unit 102 by returning the energy transport media to the outside unit when having being heated in the indoor unit 101 that is installed in the indoor space to be conditioned. Because the cooling capacity is isolated to the outdoor unit 102 all heavy and noisy components can be confined to the outside unit and the indoor environment can be close to free of noise. Also, there is very little space required for the indoor unit. Because the piping system 103 used to transfer heat between the indoor unit 101 system can be a low-pressure system it can use an energy transport media that is easy to handle, such as water a water based solution, or some other liquid media such as ethanol.

Thus, in accordance with some embodiments, an aqueous media can be used to transport the energy from the indoor space to be conditioned to the evaporator located in the external packaged device. The main pump 205 will ensure the flow of the energy transport media by pumping the aqueous media, and the external cooling unit will reject the heat generated in the process to the ambient outdoor air. This is made possible since the external, packaged cooling system located in the outdoor unit can comprise all the standard constitutive elements in a refrigeration system, such as compressor, condenser, expansion device, evaporator and control system, and refrigerant. In accordance with some embodiments the liquid to refrigerant heat exchanger 204 can be a light brazed plate heat exchanger or a coaxial-type heat exchanger. The liquid to refrigerant heat exchanger 204 can be made of aluminium to make the weight low. The air-to-refrigerant heat exchanger 215 can be a micro channels heat exchanger or a fins & tubes air cooled heat exchanger. The material of the micro channel heat exchanger and or the fins and tube heat exchangers can be Aluminum, and/or aluminum & copper.

By using the system as set out herein, the refrigeration system becomes very small, given the possibility to decrease its size and weight, so facilitating its installation through a window in a residence. Additionally, by having such a compact system with a secondary circuit transporting energy between the indoor unit and the outdoor unit using an energy transport media, the installation will not need to be permanent, and it can be easily removed and reinstalled in different places any number of times according to the convenience of the user. This can be made without having to handle the refrigerant of the external packaged cooling system.

The liquid tank 208 placed on the top of the indoor unit 101 can be provided with an internal one-way valve 224 (shown schematically). By providing the liquid tank 208 at a highest position of the piping system and providing the one-way valve 224 at the liquid tank filling of the piping system with water or any other energy transport media used, can be made once the installation has been done. The positioning of the liquid tank 208 and the one-way valve 224 allows in turn the elimination of the air from the system. This ensures a proper operation of the air-conditioner, and prevents problems like galvanic corrosion due to interaction between e.g. an aqueous solution and oxygen from air.

In accordance with one embodiment, the external packaged cooling system can be provided with a 4-way valve (not shown) in the refrigerant to enable a switch in the direction of the refrigerant flow, allowing the system to work as a heat pump device for winter conditions. Hereby an arrangement is provided whereby the air-conditioner can be switched between a cooling mode and a heating mode. In the heating mode, the energy transport media will introduce the heat generated in the external packaged cooling device of the outdoor unit 102, to circulate to the indoor unit 101 to heat the indoor space where the indoor unit 101 is located.

While it is possible to use any energy transport media to transport energy between the indoor unit 101 and the outdoor unit 102 via the connection system 103, the use of an aqueous solution as energy transport fluid offers the advantage of being innocuous and safe for the user. Further there is no need to pressurize the media in the connection system 103, since it can work at a relatively low pressure, in particular at or near atmospheric pressure. Hereby, the connections of the connection system 103 interconnecting the indoor unit 101 with the outdoor unit 102 can be made less complex compared to systems using pressurized gases above atmospheric pressure.

The present invention offers all the advantages of a standard split AC, in terms of performance, low noise, reliability, but adding versatility and flexibility to the installation process. It also solves the problem of the high initial investment, normally associated to the additional installation cost of standard split AC's.

The invention claimed is:

1. An air conditioner configured to be installed in a window, the air conditioner comprising:

an indoor unit comprising a single first housing containing an indoor heat exchanger for cooling or heating air in the indoor unit;

an outdoor unit comprising a single second housing containing a compressor, a first outdoor heat exchanger, and a second outdoor heat exchanger;

a piping system interconnecting the indoor unit with the outdoor unit; and a liquid tank fluidly connected to the piping system and located outside and separate from the first housing and the second housing;

wherein:

the compressor is configured to drive a refrigerant via the first outdoor heat exchanger and the second outdoor heat exchanger in a refrigerant circuit;

the piping system is configured to circulate an energy transport media along a continuous path from the first outdoor heat exchanger to the indoor heat exchanger; and the piping system is configured to receive the energy transport media from the liquid tank and not deliver the energy transport media to the liquid tank.

2. The air conditioner according to claim 1, wherein the energy transport media is a water based solution.

3. The air-conditioner according to claim 1, wherein a main pump is provided in the indoor unit to circulate the energy transport media.

4. The air-conditioner according to claim 1, further comprising a box located under the indoor heat exchanger for collecting condensate water.

5. The air-conditioner according to claim 4, further comprising a pump configured to pump condensate water from the indoor unit to the outdoor unit.

6. The air-conditioner according to claim 1, wherein the piping system comprises a connector provided in the piping system, wherein the connector is configured to connect a first portion of the piping system in the indoor unit to a second portion of the piping system in the outdoor unit.

7. The air-conditioner according to claim 1, further comprising an arrangement for switching the air-conditioner between a cooling mode and a heating mode.

8. The air-conditioner according to claim 1, wherein at least one of the first and second outdoor heat exchangers is made of aluminum.

9. The air conditioner according to claim 6, wherein the connector is located at a top part of the outdoor unit.

10. The air-conditioner according to claim 1, wherein, when the indoor unit is mounted, the liquid tank is located at a top position of the piping system.

11. The air-conditioner according to claim 1, wherein the liquid tank is connected to the piping system by a one-way valve.

12. The air conditioner according to claim 1, wherein the liquid tank is connected to the piping system solely by a tank outlet.

13. The air conditioner according to claim 3, wherein the liquid tank is connected to the piping system by a single flow path, the single flow path connecting the liquid tank to a suction port of the main pump.

14. The air conditioner according to claim 1, wherein the piping system is configured to circulate the energy transport media along the continuous path between the first outdoor heat exchanger and the indoor heat exchanger without passing through the liquid tank.

* * * * *